US005582515A

United States Patent [19]

Eisinger et al.

[11] Patent Number: 5,582,515

[45] Date of Patent: Dec. 10, 1996

[54] ACOUSTICALLY PULSATING BURNER WITH INTEGRAL ADJUSTABLE SONDHAUSS THERMOACOUSTIC ELEMENTS

[75] Inventors: Frantisek L. Eisinger, Demarest, N.J.; Martin D. Bernstein, Bronx, N.Y.

[73] Assignee: Foster Wheeler Energy Corporation, Clinton, N.J.

[21] Appl. No.: 434,893

[22] Filed: May 4, 1995

[51] Int. Cl.[6] ..... F23C 11/04

[52] U.S. Cl. ..... 431/1; 431/8; 431/114; 431/186

[58] Field of Search ..... 431/1, 79, 75, 431/8, 19, 346, 186, 114, 187

[56] References Cited

U.S. PATENT DOCUMENTS

| | | | |
|---|---|---|---|
| 4,770,626 | 9/1988 | Zinn et al. | 431/1 |
| 5,015,171 | 5/1991 | Zinn et al. | 431/1 |
| 5,118,281 | 6/1992 | Bramlette et al. | 431/1 |
| 5,209,656 | 5/1993 | Kobayashi et al. | 431/187 |
| 5,266,024 | 11/1993 | Anderson | 431/11 |
| 5,266,025 | 11/1993 | Francis, Jr. et al. | 431/187 |
| 5,267,850 | 12/1993 | Kobayashi et al. | 431/8 |

*Primary Examiner*—Larry Jones
*Attorney, Agent, or Firm*—Martin Smolowitz

[57] ABSTRACT

An acoustically pulsating burner assembly which includes an elongated outer tube, a fuel supply means located within the tube, and utilizes one or more integral axially adjustable Sondhauss thermoacoustic tubular elements to generate pulsations within the burner. The acoustic pulsations are generated inside the axially movable closed end tube element provided within the burner, and these vibrations promote more efficient combustion of the fuel so as to reduce undesired emissions in the combustion products. If desired, multiple thermoacoustic tubular elements of different lengths can be advantageously used to generate pulsations of different frequencies within the burner assembly. The burner assembly is located in a furnace windbox, and can be adapted for combusting gas, oil or particulate fuels such as coal.

11 Claims, 5 Drawing Sheets

ACOUSTICALLY PULSATING BURNER WITH INTEGRAL ADJUSTABLE SONDHAUSS THERMOACOUSTIC ELEMENTS

BACKGROUND OF INVENTION

This invention pertains to acoustic pulse producing burners adapted for burning gas, liquid or particulate fuels for utility and industrial usage. It particularly pertains to such burners in which acoustic pulsations are self-induced by integral axially moveable Sondhauss thermoacoustic tubular elements to facilitate complete combustion of the fuel.

For reasons of increased combustion efficiency and reduced emissions of combustion products ($NO_x$, CO, $SO_2$), pulsed combustion is often utilized in burners for coal, gas or oil fuels. Various designs of such pulsed type burners have been developed and disclosed. For example, U.S. Pat. No. 4,529,377 to Zinn et al discloses a pulse combustor apparatus including a combustor tube having an open end and containing a combustion zone where combusting fuel produces a standing acoustic mode having nodes and anti-nodes in the tube. U.S. Pat. No. 4,699,588 to Zinn et al discloses a pulsating processing system which includes an acoustically resonant processing chamber and a frequency tunable pulse combustor which is positioned to excite natural acoustic modes in the chamber utilizing a swirling motion. U.S. Pat. No. 4,770,626 and U.S. Pat. No. 4,909,731 to Zinn et al disclose a similar tunable pulse combustor useful for chemical, physical and thermal processes, including an acoustically resonant processing chamber and a frequency tunable pulse combustor. Also, U.S. Pat. No. 5,015,171 to Zinn et al discloses a similar improved tunable pulse combustor adapted for moisture removal and particle heating, and including a combustion chamber with an axially translatable acoustic decoupling and flame holder configurations and utilizing axial translation of a flame holder within the combustor.

Although these prior art tunable combustor devices have been found useful, they utilize an acoustic combustion chamber associated with an internal flame-driven pulsating exciter means. However, further burner improvements have been sought and have resulted in the more efficient acoustically pulsating type burner assembly of this invention.

SUMMARY OF INVENTION

The present invention provides an acoustically pulsating burner assembly, for which acoustic pulsations are generated inside at least one thermoacoustic tubular element located within the burner to facilitate combustion of gas, liquid or particulate fuels supplied through the burner. The burner assembly includes an elongated outer tube, a fuel supply means located within the outer tube, and at least one thermoacoustic tubular element located within the outer tube.

Each thermoacoustic tubular element consists of an elongated tube having a closed forward warm end facing a combustion furnace, and an open cool rearward end located away from the furnace. These Sondhauss thermoacoustic tubular element(s) are located within the elongated outer tube and in an air supply stream to the furnace, and their position within the burner is axially adjustable. The axial position of the thermoacoustic tubular element(s) within the burner assembly determines the temperature gradient along the length of the Sondhauss tubular element which drives the pulsations. This temperature differential governs the intensity of the acoustic pulsations, and the axial position of the Sondhauss tubular element(s) will determine the magnitude of the pulsations. When the thermoacoustic element(s) is moved away from the furnace, the temperature differential along the tube is reduced and no vibrations occur. By moving the thermoacoustic tubular element(s) towards the furnace, the temperature differential increases and vibrations will start when the temperature differential between the hot and the cold sections of the Sondhauss tube reaches a critical value. Further movement of the tubular element(s) towards the hot furnace will increase the intensity of the oscillations. The ratio of absolute temperature between the hot forward end and cooler rear ends of the thermoacoustic tube should be in the range of 2–3/1. The thermoacoustic tubular element(s) are slidably supported within the burner by suitable supports or bearings, and the positioning of the thermoacoustic element(s) can be achieved by means of a suitable hydraulic or mechanical mechanism controlled from outside the burner.

The frequency of pulsations for the thermoacoustic tubular element(s) is determined by the relationship:

$$f=c/4L$$

where f is the frequency of the acoustic pulsations, c is the speed of sound in the "cold" portion of the Sondhauss theroacoustic tube, and L is the axial length of the tube. The frequency of the sound generated will be constant for one particular length L of the tubular element. Theroacoustic tubes of different lengths can be used for generating pulses of different frequencies in a burner assembly. The burner arrangement can be such that pulsations of one frequency will be generated (utilizing one or more thermoacoustic elements of the same length), or a multiple frequency pulsations can result from a simultaneous use of multiple thermoacoustic elements having different tube lengths.

Depending upon the specific configuration of a burner assembly, the thermoacoustic element(s) can be either located on or near the burner longitudinal axis (one element), or located symmetrically about the burner axis (two or more elements) within the elongated outer tube. The ultimate location and configuration of the thermoacoustic tubular elements in a burner unit is determined by the location of the fuel supply nozzles and by the desired strength and frequency of the acoustic pulsations, with larger size burners utilizing more thermoacoustic elements. In specific burner arrangements, either the thermoacoustic tubular element or the fuel nozzle can be located on the burner centerline, and either the thermoacoustic elements or the fuel supply nozzles can be placed in a symmetrical pattern about the burner centerline within an elongated outer tube. Alternatively, only one thermoacoustic tubular element and one fuel nozzle can be provided in the elongated outer tube in an assymetric arrangement about the burner centerline. In general, for the forward most position of the thermoacoustic tubular element the closed end will extend slightly past the forward end of the burner outer tube, and in the retracted position the thermoacoustic element is withdrawn rearwardly a distance equal to about 0.5 of the burner throat diameter. For burners firing combined fuels, such as coal and gas, coal and oil, or gas and oil, an appropriate combination of the above arrangements with larger size burners utilizing more thermoacoustic tubular elements can be utilized.

The Sondhauss tube pulsations are driven by the sharp temperature differential between the warm air or gas existing at the closed forward end of the tubular element, and the cooler air or gas in the remaining rearward portion of the element. An additional aspect of this invention is to provide and control the sharp temperature differential in the tubular element by means of an adjustable outer sleeve or inner liner located along a rear portion of the tube, which sleeve or liner acts as a thermal barrier against the heat coming from the furnace.

The invention advantageously provides a burner assembly which is relatively simple in its construction and is operation, and thermally efficient in its operation for combustion of various fuels, including gas, oil, and particulate fuels such as coal, and combinations thereof. For burner units according to this invention, the outer tube which encloses the thermoacoustic element(s) and the air/fuel supply tubes can have an outside diameter of 150–750 mm and be 2,000–3,500 mm long, although larger or smaller sizes could be used, and with the outer tube being aligned with a furnace throat opening having diameter of 200–1,000 mm. The thermoacoustic tubular element(s) are usually 50–80 mm diameter and 600–950 mm long, however, smaller and larger sizes could be used. The burner parts are usually made of an alloy steel or ceramic materials suitable for extended high temperature operations.

BRIEF DESCRIPTION OF DRAWINGS

This invention will be further described by reference to the following drawings, in which.

DESCRIPTION OF INVENTION

Figure 1:
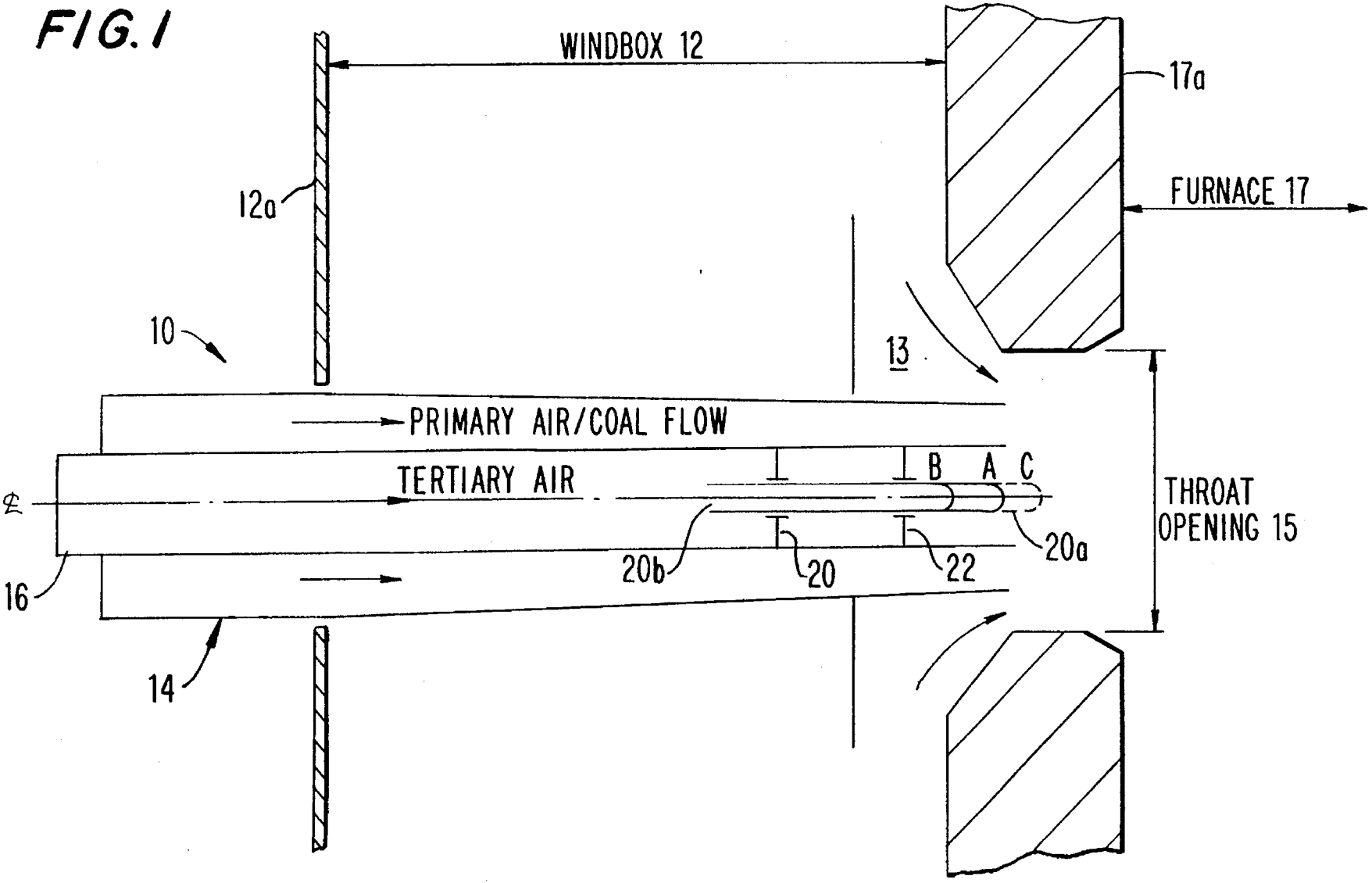
FIG. 1 shows a schematic cross-sectional view of an acoustic pulsating burner assembly having a single centrally located axially moveable thermoacoustic tubular element arrangement used for a coal-fired burner configuration.

As is shown schematically by FIG. 1, an acoustic pulsating burner unit 10 is provided and mounted in a windbox 12 of a furnace 17. The burner unit 10 includes an outer elongated tube 14 through which primary air and pulverized coal fuel are conveyed through a throat opening 15 into the furnace 17. Secondary air at 13 enters throat opening 15 from the windbox 12 having rear wall 12*a*. The outer tube 14 surrounds an inner concentric tube 16 adapted for flow of tertiary air into the furnace 17.

There is provided within the burner unit central inner tube 16 an elongated Sondhauss thermoacoustic element 20, which is closed at its forward end 20*a* and open at is rearward end 20*b*. The thermoacoustic element 20 is supported and made axially adjustable within the central tube 16 by suitable multiple bearing means 22, such as sleeve or anti-friction type bearings. When the thermoacoustic element 20 is located in a central normal position A, normal acoustically induced pulsations occur within the tube element 20, which are caused by a temperature differential along the tube length, and enhance the air fuel mixing and combustion process within the burner 10 and furnace 17. But when thermoacoustic element 20 is in a retracted position B no pulsations occur, and when element 20 is in a forward position C within central tube 16 strong pulsations occur in the burner 10. These pulsations or vibrations within the thermoacoustic tube 20 are driven by sharp temperature differences which exist between the warmer gas in the closed forward end of the tube and the cooler gas in the open rear end of the tube element 20. Such axial positioning of the thermoacoustic element 20 within inner tube 16 can be accomplished by suitable pneumatic or mechanical means (not shown).

The burner unit 10 e is centrally located within the windbox 12 and throat opening 15 of the furnace 17 by suitable support means (not shown) attached to the furnace windbox and furnace outer wall 17*a*. The burner outer 14 tube can have 150–750 mm diameter by up to 3,500 mm long, and the thermoacoustic element can be 50–80 mm diameter by 800–1,000 mm long, however, smaller or larger sizes could be used. The air/coal velocity within tube 14 can be 15–50 meter/sec.

Figure 2:
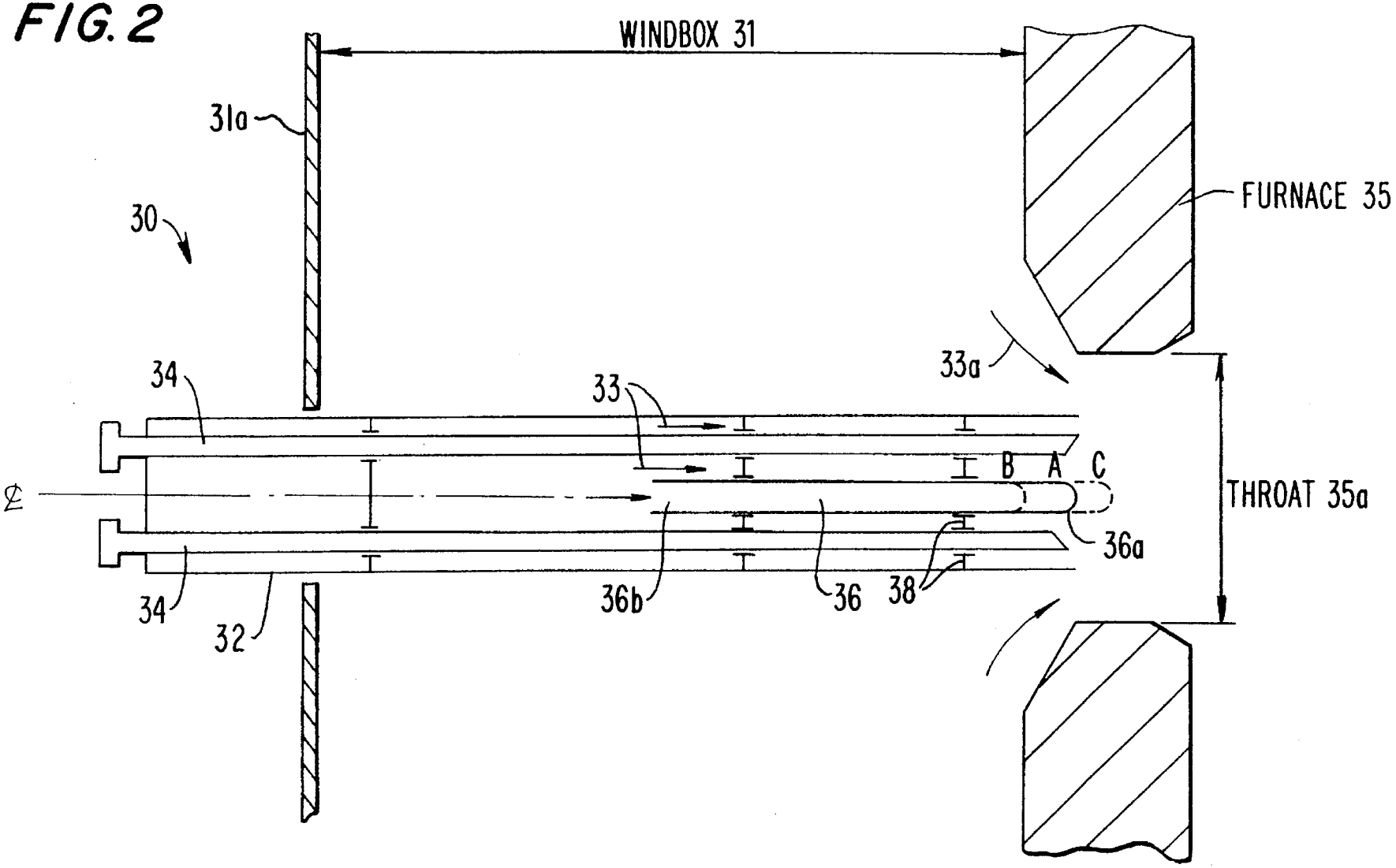
FIG. 2 shows a schematic cross-sectional view of a similar acoustic pulsating burner having a central thermoacoustic element surrounded by multiple gas firing nozzles.

As shown schematically by FIG. 2, an alternative acoustic pulsating burner unit 30 is provided and mounted in a windbox 31 of a furnace 37. The burner unit 30 includes an elongated outer tube 32 which is centrally located and suitably supported within the windbox 31 having rear wall 31*a*. Within outer tube 32 one or more gas supply tubes or canes 34 are provided, which supply fuel for combustion. Primary air is provided through the outer tube 32 through passage at 33, and secondary air is supplied at 33*a* through throat opening 35 into the furnace 37.

There is also provided within the outer tube 32 a centrally located Sondhauss thermoacoustic element 36, which is closed at its forward end 36*a*, and open at its rearward end 36*b*, and is supported at 38 by suitable support means and made axially adjustable within the central outer tube 32. When the thermoacoustic tube element 36 is in a central normal position A, normal acoustically induced pulsations occur within the tube which enhance the fuel mixing and combustion process. But when element 36 is in a retracted position B no pulsations occur, and when element 36 is in a forward position C within outer tube 32 strong acoustic pulsations occur. Similarly as for the FIG. 1 embodiment, these pulsations are driven by sharp temperature differences between the hot gas in the forward closed end of the tube and the cooler gas in the open rear end of the tube element 36.

The thermoacoustic element 36 is supported within the outer tube 32 and adjacent the gas supply tube(s) 34 by suitable bearing means 28, such as sleeve or roller type bearings. The axial positioning of element 36 can be accomplished by suitable hydraulic or mechanical means (not shown). If desired, one thermoacoustic element 36 and one or more gas supply tube(s) 34 can be mounted assymetrically within the outer tube 32. The burner outer tube 32 can have 150–750 mm outside diameter and be 2,000–3,000 mm long, while the thermoacoustic element 36 can be 50–70 mm diameter and 750–950 mm long, however, smaller or larger sizes could also be used.

Figure 3:
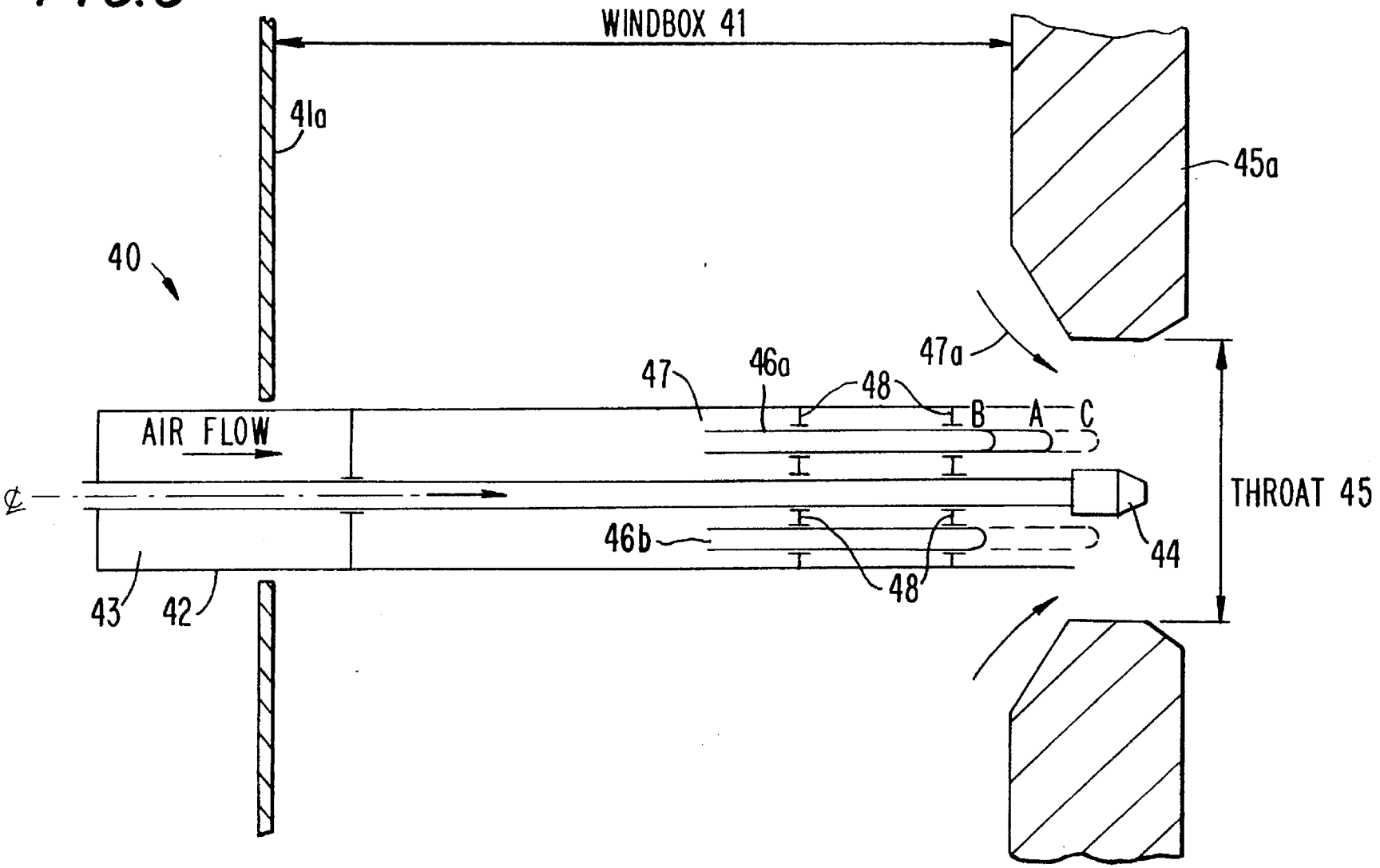
FIG. 3 shows a schematic cross-sectional view of an acoustic pulsating burner assembly having a centrally located nozzle for oil firing and which is surrounded by multiple thermoacoustic elements.

FIG. 3 shows an alternative burner unit 40 which is arranged to be suitable for combustion of oil fuel. The burner unit 40, which is mounted within a furnace windbox 41, includes an elongated outer tube 42. Within outer tube 42, an inner tube 43 provides fuel such as oil to a nozzle 44 provided at the tube forward end and within a throat opening 45 of the furnace wall 45*a*. Also within outer tube 42, at least one axially moveable Sondhauss thermoacoustic element 46 is provided. The inner fuel supply tube 43 is preferably surrounded by two and up to eight Sondhauss thermoacoustic elements 46*a*, 46*b*, etc., spaced circumferentially around the centerline of burner 40. The thermoacoustic element(s) 46 are supported within the outer tube 42 by suitable support means 48, and are made axially movable from a normal central position A in which normal pulsations occur, to a retracted position B in which no pulsations occur, or to a forward position C in which strong pulsations occur, as was explained above for the FIG. 1 and 2 embodiments. Primary air flow is provided at 47 within the outer tube 42, and secondary air flow is provided at 47*a* from windbox 41 through the furnace throat opening 45. For this FIG. 3 burner unit configuration, the burner outer tube 42 can have a diameter of 150–750 mm and length of 2,000–3,000 mm, and the thermoacoustic elements 46 can have diameter of 50–70 mm and length of 750–950 mm.

Figure 4:
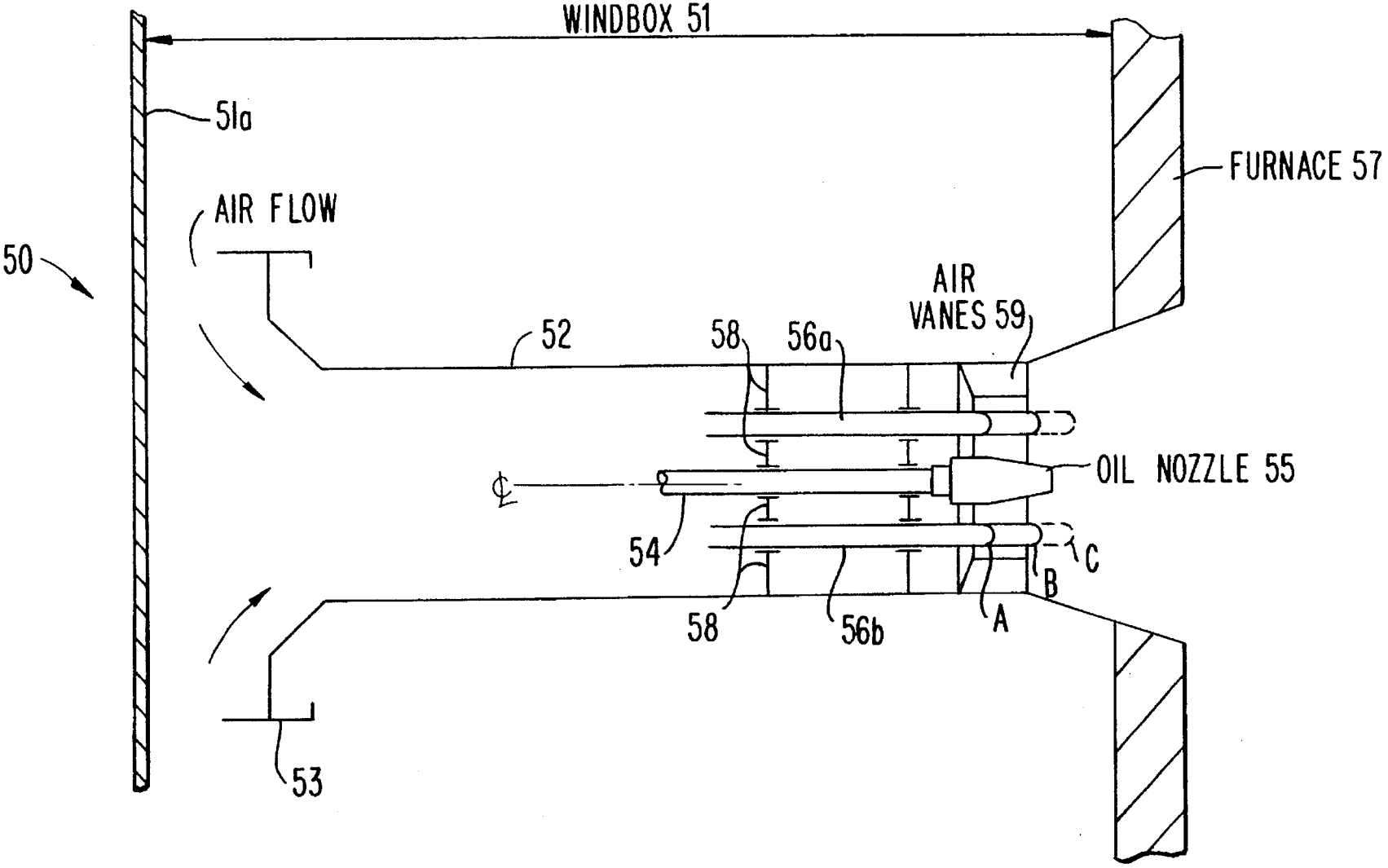
FIG. 4 shows a burner arrangement for an oil and/or gas-fired burner similar to FIG. 3 but of a different design containing air swirling vanes.

FIG. 4 shows a burner unit 50 which is suitable for combustion of either gas or oil fuels. This burner unit, which is provided within a windbox 51, includes an elongated outer stationary tube 52, and has a slideable closure member 53 provided at the tube rearward inlet end to regulate primary air flow through the tube 52. There is provided within outer tube 52 a central elongated tube 54 having a fuel nozzle 55 located at its forward end. Similarly as for the FIG. 3 embodiment, fuel supply tube 54 is accompanied by at least one, and up to eight Sondhauss thermoacoustic elements 56*a*, 56*b*, etc. which can be spaced circumferentially around the burner centerline. These thermoacoustic elements 56*a*, 56*b*, etc. are suitably supported within the outer tube 52 by bearing support means 58, such as sleeve or anti-friction type bearings. The element(s) 56 are made axially movable from a normal central position A in which normal acoustic pulsations occur, to a retracted position B in which no pulsations occur, or to a forward position C in which strong pulsations occur. These elements 56 are surrounded by multiple air swirler vanes 59 attached to the elongated outer tube 52 or tube 54 or nozzle 55. Air flow from the furnace windbox 51 passes through the adjustable closure member 53 and swirler vanes 59 into the furnace 57.

An alternate burner arrangement from that shown in FIG. 4 can utilize air swirler vanes 59 having a smaller diameter, thereby permitting axial air flow through a passage way located around the swirler within the central tube 52. In still another alternate burner arrangement, an air passage around tube 52 at the furnace wall can be provided, thereby connecting directly the windbox 51 with the furnace 57.

Figure 5:
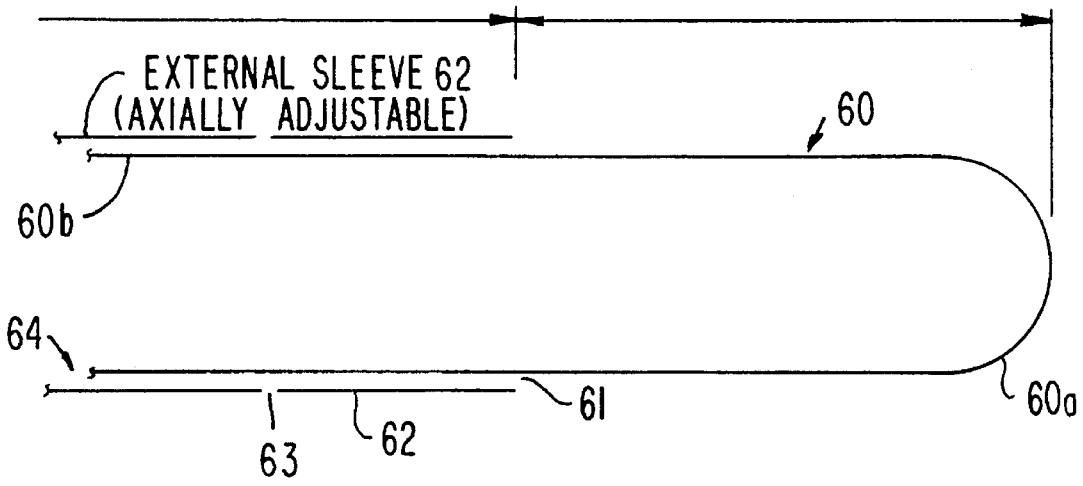
FIG. 5 shows a thermoacoustic tubular element having an axially adjustable outer sleeve provided adjacent the element open end.

Control of the sharp temperature differences and acoustic pulsation in the Sondhauss thermoacoustic element(s) of this invention may also be achieved or augmented by means of an axially adjustable outer sleeve provided near the tubular element rearward open end, as generally shown by FIG. 5. Thermoacoustic tube element 60 includes a forward warm end 60*a* and a cooler rear end 60*b*. Surrounding the cool rear end portion 60*b* is an axially moveable outer sleeve 62, which has narrow annular space 61 provided therebetween. Pulsations within the thermoacoustic element 60 can be additionally controlled by a cool air or gas stream provided at 64 through annular space 61, which serves to increase the temperature difference between the forward hot and rearward cool end sections of the thermocoustic tube element 60. Also if desired, the sleeve 62 can contain a plurality of orifices 63 located along its length for escape of the cooling air or gas provided at 64. Sleeve 62 is made axially moveable relative to tube 60 by suitable mechanical means (not shown).

Figure 6:
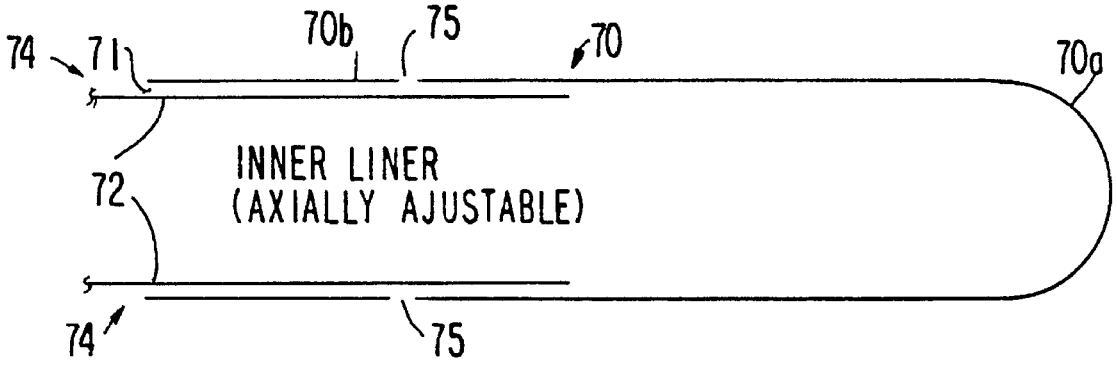
FIG. 6 and 6A show an alternative thermoacoustic tubular element having an axially adjustable inner sleeve provided adjacent the element open end.
Figure 6A:
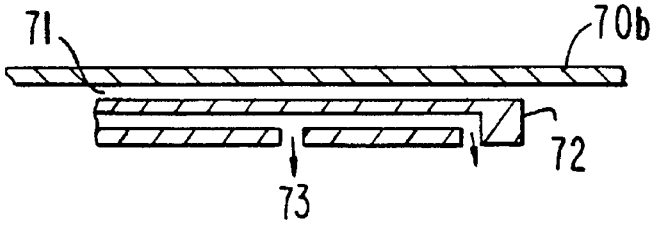

An alternate means for controlling pulsations in the thermoacoustic tube element(s) is shown by FIG. 6. Elongated tube element 70 includes forward hot end 70*a* and cooler rear end 70*b*. Provided within the tube cooler rear end 70*b* is an axially adjustable inner liner 72, which has a narrow annular space 71 provided between the liner and the tube 70. The thermoacoustic pulsations in element 70 can be additionally controlled by providing a cool air or gas stream 74 through the annular space 71. Also if desired, the liner 72 can contain a plurality of orifices 73, as shown in an enlarged scale at FIG. 6A, and through which the cooling air or gas can exit into the tube element 70. Alternatively, the rear portion of thermoacoustic tube 70 can contain a plurality of orifices 75 through which the cooling gas provided at 74 can exit from the tube element 70. The inner liner 72 is made axially moveable by suitable mechanical means (not shown).

This invention will be further described by means of a typical Example of a burner assembly, which should not be construed as limited the scope of the invention.

EXAMPLE

An acoustically pulsating burner assembly is constructed similarly as shown in FIG. 1, having an elongated outer tube, an elongated inner tube, and a single Sondhauss thermoacoustic element centrally located on the longitudinal axis of the burner. This burner assembly is installed adjacent to a throat opening into a combustion furnace. Pulverized coal is conveyed by primary air flow through the burner for combustion in the furnace, such as for providing heat for generating pressurized steam.

Important dimensional and operational characteristics of the burner are as follows:

Furnace throat diameter, mm 1,100

Outer tube length, mm 3,500

Outer tube diameter, mm 750

Inner tube diameter, mm 375

Thermoacoustic element length, mm 920

Thermoacoustic element diameter, mm 75

Primary air velocity, m/s 15–50

Secondary air/coal velocity, m/s 30–60

Furnace combustion temperature, °C. 1,700

Ratio of absolute temperatures between the hot and the cooler section of the thermoacoustic element(s) 2.5

Axial movement of thermoacoustic element, mm 600

Although this invention has been described broadly and in terms of specific embodiments, it will be understood that modifications and variations can be made all within the scope as defined by the following claims.

We claim:

1. An acoustically pulsating type burner assembly for use with a furnace for combustion of gas, liquid or particular fuels, comprising:

an elongated outer tube which can be positioned near a throat opening of a furnace and is adapted for air/fuel flow through the tube;

at least one thermoacoustic tubular element located within said elongated outer tube, said tubular element having a closed forward end and an open rearward end; and means for moving said thermoacoustic element axially within said outer tube between a forward position and a rearward position, so as to control acoustic pulsations generated within the thermoacoustic tubular element of the burner assembly to facilitate combustion of the fuel.

2. The burner assembly according to claim 1, wherein at least two axially movable thermoacoustic tubular elements of different length are provided within said outer tube, so as to generate acoustic pulsations of at least two different frequencies within the burner.

3. The burner assembly according to claim 1, wherein an axially adjustable outer thermal sleeve is provided on a rearward portion of said thermoacoustic tubular element to facilitate temperature control for the element.

4. The burner assembly according to claim 1, wherein an axially adjustable inner liner is provided in a rearward portion of said thermoacoustic element to facilitate temperature control for the element.

5. The burner assembly according to claim 1, wherein said thermoacoustic tubular element is axially movable from a forward position in which the closed front end extends past the outer tube forward end to a rearward position in which the closed front end is withdrawn by a distance equal to about 0.5 times the outer tube diameter.

6. The burner assembly according to claim 1, including an elongated inner tube means for conveying air and concentrically located between said outer tube and one said thermoacoustic tubular element so as to provide an annular-shaped passageway between the outer and inner tubes, so that primary air and a fuel can be conveyed through said annular passageway into a furnace for combustion therein.

7. The burner assembly according to claim 1, including multiple elongated tubular canes located within said annular space between said outer tube and said thermoacoustic tubular element.

8. The burner assembly according to claim 1, including an elongated inner tube means for fuel supply centrally located within said outer tube, and multiple said thermoacoustic tubular elements are provided within the annular space between the inner and outer tubes.

9. The burner assembly according to claim 1, wherein said elongated outer tube is attached at its forward end to a furnace wall, and an axially movable closure device is provided at the outer tube rear end to control primary air flow through the outer tube.

10. The burner assembly according to claim 1, wherein said outer tube has a diameter of 150–750 mm and a length of 2,000–3,500 mm, and said thermoacoustic tubular element has a diameter of 50–80 mm and a length of 650–950 mm.

11. An acoustically pulsating type burner assembly adapted for use with a furnace for combustion of particulate carbonaceous fuels, comprising:

an elongated outer tube which can be positioned near a throat opening of a furnace and is adapted for primary air/coal flow through the tube;

an elongated inner tube located concentrically within said outer tube for conveying air;

at least one elongated thermoacoustic tubular element located concentrically within said elongated inner tube, said tubular element having a closed front end and an open rear end;

means for supporting and moving said thermoacoustic tubular element axially within said inner tube between a forward position and a rearward position, so as to control the acoustic pulsations generated within the thermoacoustic tubular element of the burner assembly to facilitate combustion of the fuel.

* * * * *